United States Patent [19]

Peterson

[11] Patent Number: 4,563,107

[45] Date of Patent: Jan. 7, 1986

[54] ARCH BEAM STRUCTURE

[75] Inventor: Carl W. Peterson, Edmonton, Canada

[73] Assignee: Nova Span International Ltd., Lethbridge, Canada

[21] Appl. No.: 494,444

[22] Filed: Apr. 26, 1982

[30] Foreign Application Priority Data

Jun. 17, 1981 [CA] Canada ..... 380017

[51] Int. Cl.[4] ..... E01F 5/00

[52] U.S. Cl. ..... 405/124; 405/157

[58] Field of Search ..... 405/124, 125, 126, 134, 405/137, 155, 157

[56] References Cited

U.S. PATENT DOCUMENTS

| | | | |
|---|---|---|---|
| 268,927 | 12/1882 | Newton | 405/124 X |
| 1,549,078 | 8/1925 | Ferguson | 405/134 X |
| 3,508,406 | 4/1970 | Fisher | 405/124 |
| 4,171,174 | 10/1979 | Larsen | 405/157 X |

FOREIGN PATENT DOCUMENTS

| | | | |
|---|---|---|---|
| 1270884 | 7/1961 | France | 405/124 |

*Primary Examiner*—David H. Corbin

*Attorney, Agent, or Firm*—William R. Hinds; George H. Dunsmuir

[57] ABSTRACT

An arch-beam structure for use in combination with a culvert or the like includes a panel, which is cast or placed on the usual metal culvert conduit, the panel covering the top of the conduit, and having arms extending horizontally outwardly beyond the sides of the conduit for the purpose of transferring loads occurring on the panel-conduit system to the soil at the sides thereof, confining and thus increasing resistance to failure in the area of the soil or backfill materials adjacent to the structure.

10 Claims, 6 Drawing Figures

ARCH BEAM STRUCTURE

BACKGROUND OF THE INVENTION

1. Field of the Invention

This invention relates to an arch-beam-culvert structure and in particular to an arch-beam structure for use in the construction of culverts or the like.

2. Discussion of the Prior Art

At present, metal culvert type structures are constructed using arcuate metal plates forming the basic structure, and sometimes including buttresses. Such structures are described in, i.e., Canadian Pat. Nos. 749,630; 804,292; and 862,492, which issued to C. L. Fisher on Jan. 3, 1967; Jan. 21, 1969; and Feb. 2, 1971, respectively.

In general, existing culvert type structures rely on passive earth resistance of the soil adjacent to the flexible metal structure or buttresses to strengthen and support the structure. Where shallow depth of cover is encountered, the weakest point of structures of this type is often in the area of the top arch of the structure and in the areas of the upper portions of the sides. The frictional resistance of the soil, and soil overburden confining pressure may be low in such areas because of the relative closeness to free ground surface, and the outward thrusting arching reaction forces may be large. Assuming that the flexible plates used in the structures are sufficiently strong, the weakness in such structures is in yielding or movement of the backfill material and/or in the adjoining natural ground. Failure surfaces may develop from an area of highly stressed backfill, usually where the radius of curvature of the structure is small, to a point on the surface of the fill or overburden along a failure plane or curve determined by a variety of parameters, including soil properties and the geometry of the structure. The flatter or more horizontally ellipsed the structure or the shallower the overburden, the greater the problem, since the side radii of such a structure are necessarily small and consequently the pressures tending to cause failure are larger, these pressures being related inversely to the radii.

Failure in the described area may result in a lack of sufficient support for the arching of the structure roof, thus allowing the roof to excessively deform or collapse.

However, there is a definite need for flatter structures and for structures with shallower cover or overburden because wide, low structures permit the flow of larger volumes of water at any given headwater elevation at the entrance to the structure. Thus, wide, low structures reduce the likelihood of flooding upstream of the structures; lower the overhead gradeline and overburden required; and, assuming that the structural strength problems are solved, at reasonable cost, lead to more economical construction. By the same token, a flatter structure often constitutes the best configuration for vehicle underpasses, utility conduits, pedestrian walkways, etc.

The solutions to the problems inherent with flat structures offered by the patents mentioned hereinbefore are in some instances unnecessarily complicated and in others are not of sufficient strength since they do not confine the soil adjacent to the principle reactions. Therefore, they do not provide for construction and operation under extremely shallow covers, as does the present invention.

The object of the present invention is to alleviate at least partially the problems encountered in the construction of culverts having a planar or arcuate top surface, i.e., metal culvert-type structures, by providing a relatively simple, strong arch-beam structure which provides substantial confining means adjacent to the edge or side of the structure.

GENERAL DESCRIPTION OF INVENTION

Accordingly, the present invention relates to an arch-beam structure for use with a culvert of the type including an elongated conduit having top, bottom and side surfaces, said arch-beam structure comprising a concrete panel for extending across the top surface of said conduit and beyond the side edges thereof, the panel including a central portion including a bottom surface, the shape of said central portion bottom surface substantially conforming to the shape of the top surface of said conduit; and an arm extending outwardly, substantially horizontally from each side of said central portion for distributing the forces when in use.

The arch-beam structure hereinbefore defined may be used in the construction of new structures or for strengthening existing culvert structures. When used for the latter purpose, the arch-beam structure is placed in position on a flexible metal conduit after the overburden has been removed, and the overburden is then replaced on the arch-beam structure.

BRIEF DESCRIPTION OF THE DRAWINGS

The invention will now be described in greater detail with reference to the accompanying drawings, which illustrate a preferred embodiment of the invention, and wherein.

DESCRIPTION OF PREFERRED EMBODIMENTS

With reference to the drawings, the arch-beam structure of the present invention which is generally indicated at 1 is intended for use with a conventional culvert of the type including a conduit, the sides 2 and the top 3 of which are defined by arcuate sheets being embedded in concrete footings 4. The bottom or invert 5 of the conduit is defined by the ground or by a floor as may be suitable.

It will be appreciated that while a structure is described for use over a single conduit where two or more conduits are to be covered, the invention as defined hereafter will be adapted to accommodate multiple conduit installations.

Figure 2:
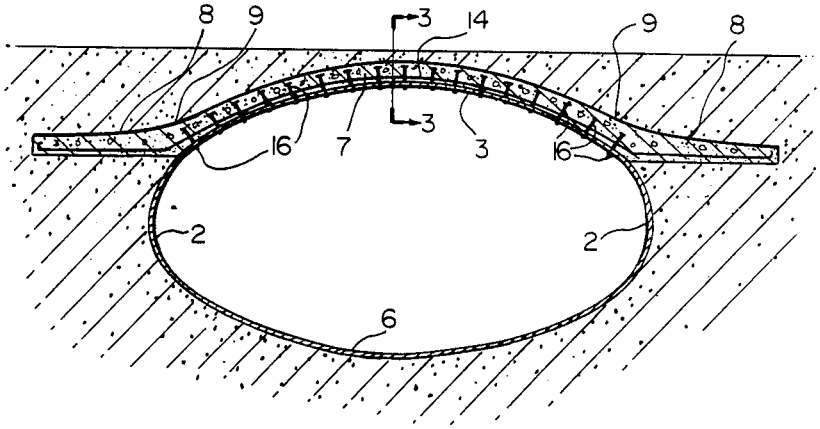
FIG. 2 is a schematic cross-sectional view of another form of an arch-beam structure with the overburden in place.

For the sake of simplicity, wherever possible the same reference numerals are used throughout the drawings. In the arch-beam structure of FIG. 2, the corrugated metal sheets define an elliptical shaped structure, i.e., the sides 2; top 3 and bottom 6 of the conduit are defined by the corrugated sheets.

In each case, the arch-beam portion of the arch-beam structure is a concrete panel defined by an arcuate centre portion 7, which conforms substantially to the shape of the top 3 of the conduit. The centre portion 7 of the arch-beam structure completely covers the top 3 of the conduit, which in the extreme case may be planar. Arms 8 are integral with and extend outwardly from each side of the centre portion of the panel and along the length thereof. The thickness of the panel is shown as being constant throughout the area of the centre portion 7, but may vary as required and generally greater at the junctions 9 between the centre portion 7 and the arms 8 in this illustration, but may vary as required to suit the loads. The arms 8 are here shown tapered outwardly, having a top surface 10 inclined downwardly and outwardly with respect to bottom surface 11, but may be of any constant or varying thickness as required.

Figure 1:
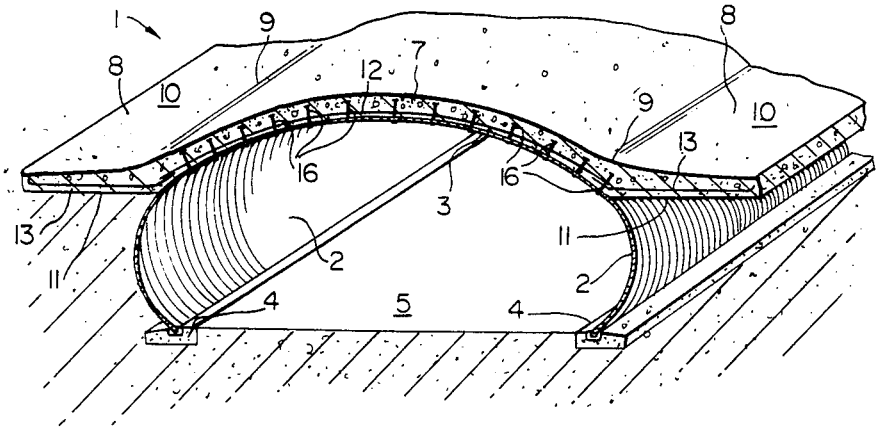
FIG. 1 is a schematic, perspective view from above a section of an arch-beam structure in accordance with the present invention.
Figure 3:
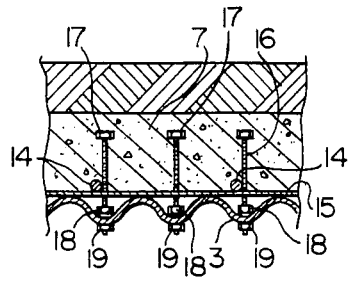
FIG. 3 is a schematic, cross-sectional view taken generally along line 3—3 of FIG. 2.

The panel of FIG. 1 is reinforced by transversely extending metal reinforcing rods 12 and 13, which are lap-spliced to each other in the areas of the junctions 9. Obviously, the transversely extending reinforcing rods can be spliced at any point or can be one piece, as is the case with the rod 14 of FIG. 2. The panel is also reinforced by longitudinally extending, spaced-apart rods 15 (one shown in FIG. 3), and by connecting bolts 16. The principal function of the rods 15 is to hold up the rods 12 or 14 during construction, but they also serve to distribute loads on the panel longitudinally of the structure. The heads 17 and bolts 16 are embedded in the concrete of the panel. The shanks of the bolts extend downwardly through the top 3 of the metal conduit. Nuts 18 and 19 are provided on the bolts 16 in position during construction of the archbeam and for holding together and making composite the conduit and the panel.

Figure 4:
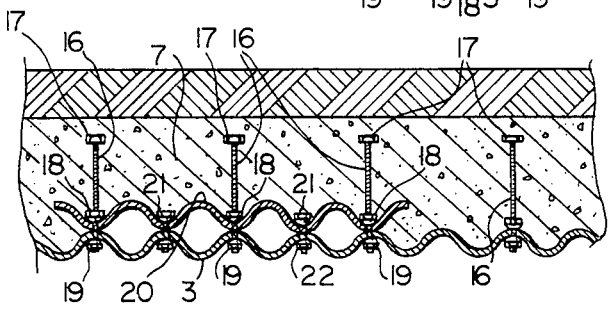
FIG. 4 is a schematic, cross-sectional view similar to FIG. 3 illustrating a modification of the arch-beam structure of FIGS. 1 and 2.

Another form of reinforcement are spaced-apart strips 20 (one shown in FIG. 4) of corrugated metal or other suitable metal sections extending transversely of the arch-beam. The strips 20 are connected to the top 3 of the conduit and to the concrete panel by the bolts 16 and nuts 18 and 19 which may be alternated with shorter bolts 21 and nuts 22 as shown. In the embodiment of FIG. 4, the panel is connected to the top 3 of the metal conduit, and thus forms a composite structure with the metal conduit.

Figure 5:
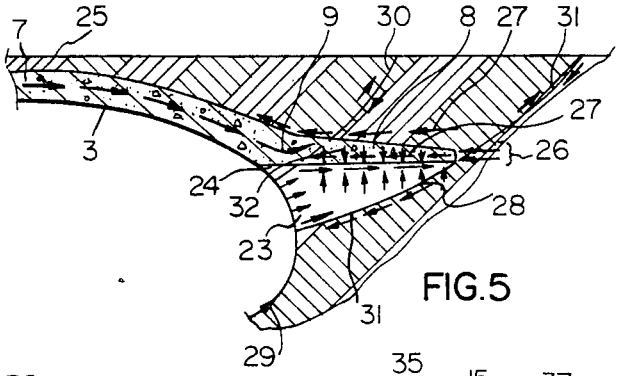
FIG. 5 is a schematic, cross-sectional view of one side of the arch-beam structure.

While the panel could be precast, the normal practice would be to fabricate the panel on site, i.e., where the structure is being installed. The arms 8 transmit at least a portion of the arch reaction, live load and overburden loads to the soil in the area 23 (FIG. 5). The distance that each arm 8 projects beyond the site of the conduit is determined by the loads to be transferred, backfill material and adjacent soil strength and by the amount of confinement of side soil required.

In order to construct a culvert or the like, the conduit is assembled in its final location and is backfilled approximately to point 24 (FIG. 5), and the concrete panel is then cast on the conduit and on the backfill.

With reference to FIG. 5, when the arch is covered by a shallow fill 25, the arcuate centre portion 7 of the arch is a substantially rigid element for sustaining flexural and compressive stresses. Loads from the centre portion 7 are transferred to the arms 8. Restraining forces 26 and 27 bear against the ends and faces of the arms 8 and against the top surface of the centre portion 7, respectively. Vertical loads are resisted by forces 28 in the soil. Thus, the conduit compression load indicated at 29 is reduced in the region beneath the point 24. The horizontal arm 8 provides a cut-off point for critical shear paths, i.e., 30, lengthening such path to a line 31 at the outer end of the arm 8. The vertical forces 32, (FIG. 5), act downward, thus providing a confining effect on the soil or backfill material under arms 8 and adjacent to the structure, and thus increasing the resistance to movement and possible failure in this normally highly stressed zone.

Figure 6:
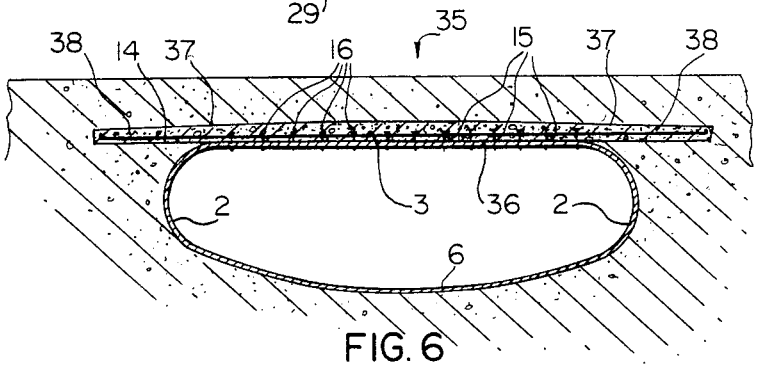
FIG. 6 is a schematic, cross-sectional view of yet another form of arch-beam structure with the overburden or backfill in place.

With reference to FIG. 6, the arch-beam structure generally indicated at 35 is used in a culvert including a conduit defined by sheets of corrugated metal. The conduit has a generally elliptical cross-sectional configuration, with arcuate sides 2, a generally planar top 3, and an arcuate bottom 6. Hereinafter, the cross-section configuration of the conduit is referred to as "truncated elliptical".

The arch-beam structure 35 is a generally planar concrete panel. The panel includes a planar bottom surface 36, and a top surface defined by a pair of outwardly and downwardly inclined sides 37. Thus, the panel tapers slightly from its longitudinal centre outwardly toward each side thereof. The thickness of the panel may be constant or vary throughout the width as required.

The panel is reinforced by transversely extending reinforcing rods 14 (one shown), or by lap-spliced rods of the type illustrated in FIG. 1. The panel is also reinforced by longitudinally extending spaced-apart rods 15, and by connecting bolts 16. As mentioned hereinbefore, the principal function of the rods 15 is to hold up the rods 14 during construction, but they also serve to distribute loads on the panel longitudinally of the structure.

The other reinforcing elements described hereinbefore with reference to FIGS. 1 to 5 can also be incorporated in this embodiment of the arch-beam structure. The arms 38 transmit at least a portion of the arch reaction, live load and overburden loads to the soil. The distance each arm 38 projects beyond the side 2 of the conduit is determined by the loads to be transferred, backfill material and adjacent soil strength, and by the amount of confinement of side soil required.

Further modifications and alternative embodiments of the invention will be apparent to those skilled in the art in view of the foregoing description. Accordingly, this description is to be construed as illustrative only and is for the purpose of teaching those skilled in the art, the manner of carrying out the invention. It is further understood that the form of the invention herewith shown and described is to be taken as the presently preferred embodiment. Various changes may be made in the shape, size and general arrangement of components, for example, equivalent elements may be substituted for those illustrated and described herein, parts may be used independently of the use of other features, all as will be apparent to one skilled in the art after having the benefits of the description of the invention.

What I claim is:

1. In a subsurface culvert structure of the type including an elongated conduit having top, bottom and side surfaces, the improvement comprising an arch-beam structure comprising a concrete panel extending across the top surface of said conduit beyond the side edges thereof, the panel including a central portion connected with said conduit to form a composite structure of panel and conduit and including a bottom surface, said central portion bottom surface substantially conforming to the shape of the top surface of said conduit; and an arm extending outwardly, substantially horizontally from each side of said central portion for distributing forces when in use.

2. A structure according to claim 1, wherein said arm includes a planar bottom surface for extending horizontally outwardly from the conduit, and an outwardly and downwardly inclined top surface.

3. A structure according to claim 1, wherein said panel is thickest at the longitudinal centre thereof.

4. A structure according to claim 1, including bolt means for connecting said panel to said conduit.

5. A structure according to claim 1, including reinforcing means between said panel and said conduit for distributing loads on said panel and conduit over large areas of the panel.

6. In a subsurface culvert structure of the type including an elongated conduit having an arcuate top surface, the improvement comprising an arch-beam structure comprising a concrete panel extending across said conduit and beyond the side edges thereof, the panel including an arcuate central portion, the shape of a bottom surface of said central portion substantially conforming to the shape of the top arcuate surface of said conduit; and an arm extending outwardly, substantially horizontally from each side of said central portion for the purpose of distribution of the overburden and imposed loads occurring on the structure when in use.

7. A structure according to claim 6, wherein said arm includes a substantially planar bottom surface for extending horizontally outwardly from the conduit.

8. A structure according to claim 6, wherein said panel rests on said conduit.

9. A structure according to claim 6, including means for connecting said panel to said conduit to form a composite structure of conduit and panel.

10. A structure according to claim 6, including reinforcing means in said panel and between said panel and said conduit for development of composite action and for distributing loads on said panel and conduit over large areas of the panel, the conduit adjacent backfill material and the naturally occurring soil adjacent to the backfill.

* * * * *